US009620098B2

(12) United States Patent
White

(10) Patent No.: US 9,620,098 B2
(45) Date of Patent: Apr. 11, 2017

(54) GUITAR COMPONENT ATTACHMENT SYSTEM

(71) Applicant: Timothy P. White, New Boston, NH (US)

(72) Inventor: Timothy P. White, New Boston, NH (US)

( * ) Notice: Subject to any disclaimer, the term of this patent is extended or adjusted under 35 U.S.C. 154(b) by 0 days.

(21) Appl. No.: 15/153,343

(22) Filed: May 12, 2016

(65) Prior Publication Data

US 2016/0335997 A1 Nov. 17, 2016

Related U.S. Application Data

(60) Provisional application No. 62/160,002, filed on May 12, 2015, provisional application No. 62/214,231, filed on Sep. 4, 2015.

(51) Int. Cl.
*G10H 1/32* (2006.01)
*G10H 3/00* (2006.01)
*G10H 3/18* (2006.01)

(52) U.S. Cl.
CPC ..... *G10H 3/186* (2013.01); *G10H 2230/015* (2013.01); *G10H 2230/365* (2013.01)

(58) Field of Classification Search
CPC ..... G10H 3/186; G10H 2230/015; G10H 2230/365
USPC ..... 84/743
See application file for complete search history.

(56) References Cited

U.S. PATENT DOCUMENTS

| | | | | |
|---|---|---|---|---|
| 8,173,881 | B1 * | 5/2012 | Schenk | G10D 1/005 84/312 R |
| 9,240,170 | B2 * | 1/2016 | Chekardzhikov | G10G 7/02 |
| 2014/0224099 | A1 * | 8/2014 | Webman | G10H 3/18 84/630 |
| 2015/0082970 | A1 * | 3/2015 | Chekardzhikov | G10G 7/02 84/455 |
| 2015/0356960 | A1 * | 12/2015 | Webman | G10H 3/18 84/630 |
| 2016/0183393 | A1 * | 6/2016 | Groom | A45C 11/00 280/33.992 |

* cited by examiner

*Primary Examiner* — Jeffrey Donels
(74) *Attorney, Agent, or Firm* — Luis Figarella

(57) ABSTRACT

A magnet or array of magnets is attached to the inner surface of a stringed musical instrument such an acoustic guitar, allowing an external electronic device equipped with one or more magnet or ferromagnetic elements to be softly and removably mounted to the outer surface of the instrument without adhering to or disturbing the outer surface of the instrument. The inner-mounted magnet or magnet array may be attached permanently or removably to the inner surface of the instrument, and may have its position adjusted for optimizing the position of the externally mounted device.

2 Claims, 27 Drawing Sheets

6 a.
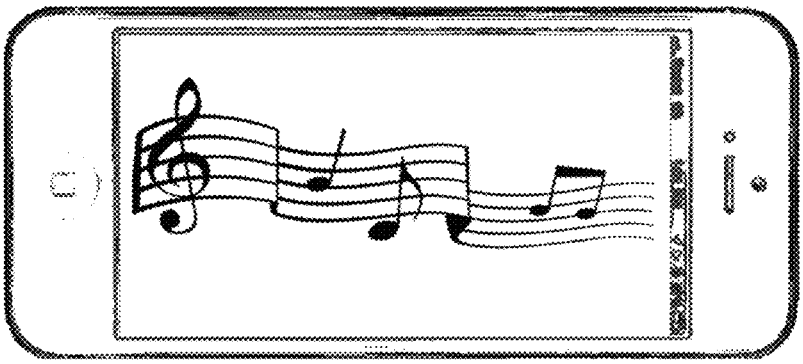
6 b.
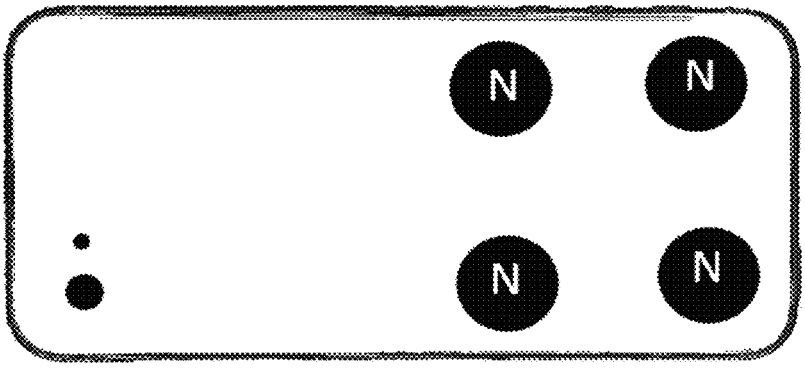
Figures 6A, 6B, 6C
6 c.
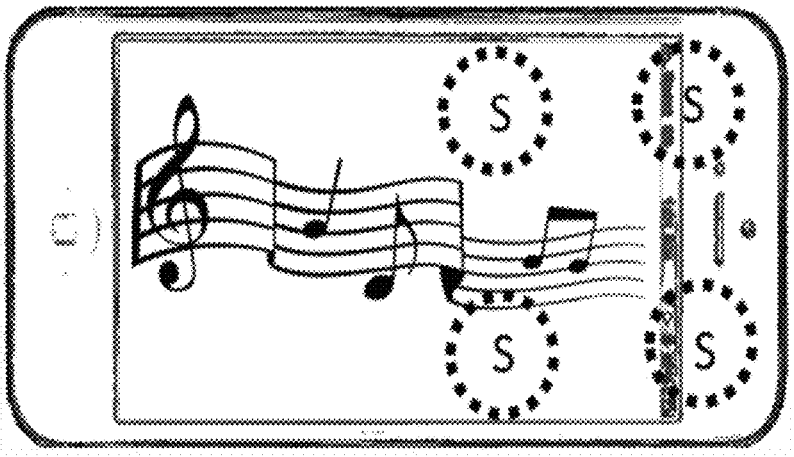

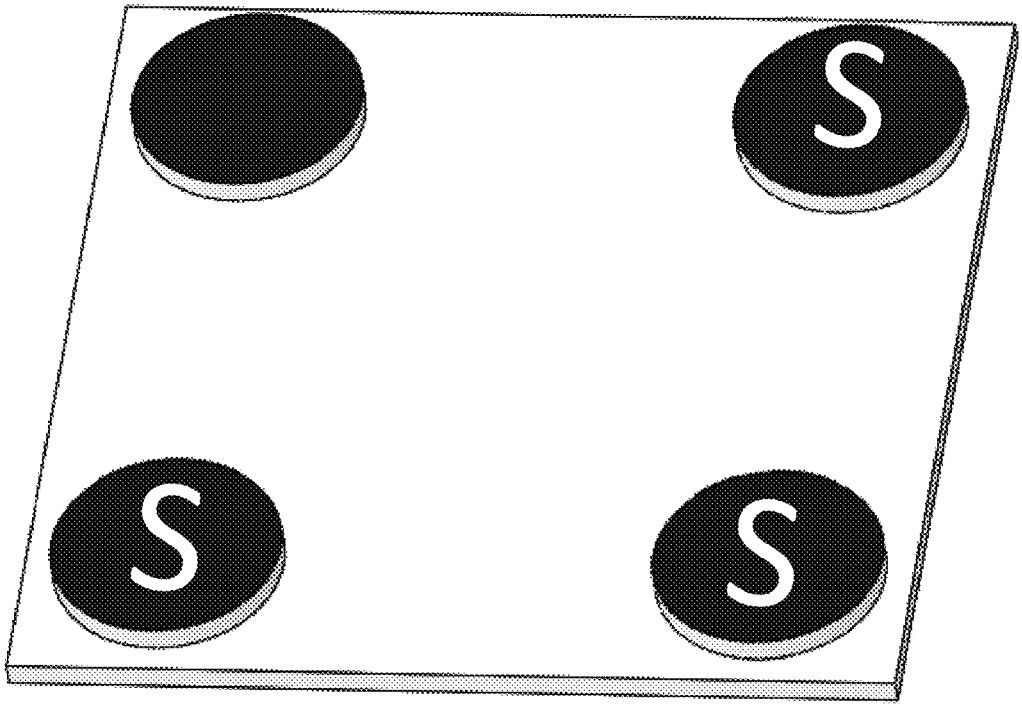
Figure 15
Figure 16
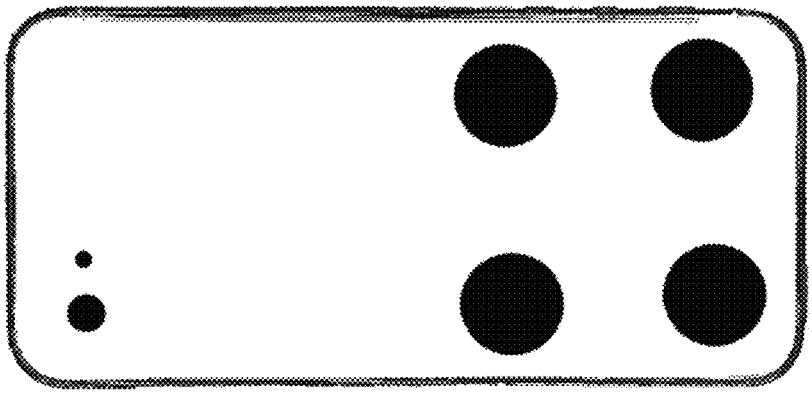

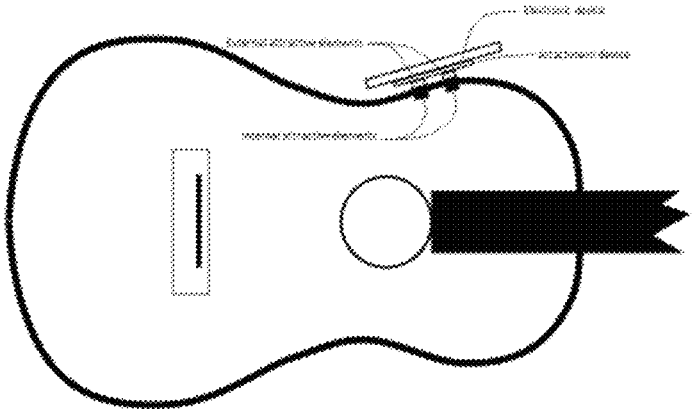
Figure 20
Figure 21
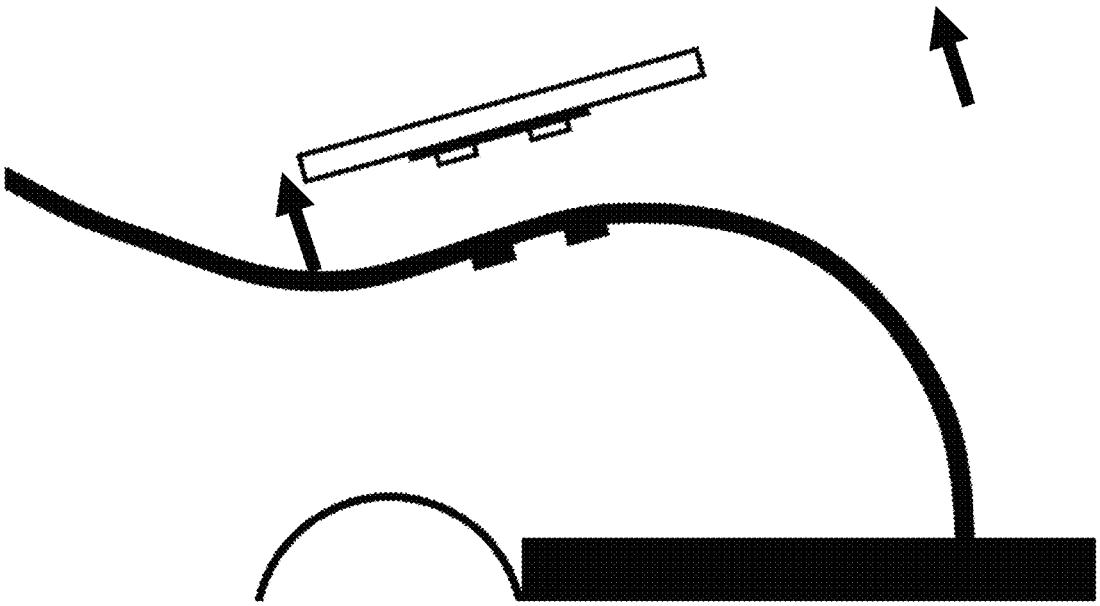

GUITAR COMPONENT ATTACHMENT SYSTEM

CROSS-REFERENCE TO RELATED APPLICATIONS

This application claims priority to U.S. Provisional patent application Ser. No. 62/160,002 titled "Guitar Component Attachment System", filed on May 12, 2015, and application 62/214,231, titled "Guitar Component Attachment System", filed on Sep. 4, 2016, the disclosure of both which is herein incorporated by reference in their entirety.

PATENTS CITED

The following documents and references are incorporated by reference in their entirety, Webman (U.S. Pat. Appl. No. 2014/0224099), White (U.S. Pat. Nos. 4,573,391; 5,945,614; 6,188,005), Jennings et al (U.S. Pat. No. 4,058,045), Donnell (U.S. Pat. Nos. 5,010,803 and 5,614,688), Gillete (U.S. Pat. Appl. No. 2009/0064853) and DeMars (U.S. Pat. Appl. No. 2008/0173165).

FIELD OF THE INVENTION

The present invention relates to an electronic control and communication system and method for musical instruments, as well as to a system and method for mounting external elements to a musical instrument without adversely affecting its sound and acoustic properties, or disturbing its surface or surface finish.

DESCRIPTION OF THE RELATED ART

It is common for an acoustic guitar to have a pickup attached to it so that it can be amplified. Different types of pickups can be used, the most common types being piezo-electric and magnetic. Magnetic pickups for acoustic guitars are commonly mounted in the vicinity of the sound hole under the vibrating strings, and have an output voltage large enough to be output directly to an external amplifier.

Piezo-electric pickups are typically attached to the underside of the soundboard of the guitar or within the bridge's saddle slot, and have a relatively weak signal requiring pre-amplification before being output to the external amplifier. It is useful for an acoustic guitarist to be able to control the volume and tone quality of their instrument.

It is common for some acoustic guitars to have a volume and tone control module built into the side of the upper bout facing and easily accessed by the player, such control modules also typically having a replaceable battery compartment accessible from the outside. Prior art tone and volume control modules for new acoustic guitars are typically mounted in a hole cut into the side of the upper bout of the instrument.

For an acoustic guitar without a control module to be fitted with one requires a mounting hole to be cut into the side of the upper bout of the instrument. Many owners of fine guitars would rather do without a control module than cut a mounting hole for one in their guitar. The present invention provides for an acoustic guitar not equipped with a control module to have one installed at the nominal location on the side of the upper bout of the instrument, but without requiring that a mounting hole be cut in the instrument, or having the surface of the instrument be disturbed in any way, for example with an adhesive.

The present invention further provides for the guitar control module to be attached in such a way as to be instantly removable or repositioned. The present invention further provides for the guitar control module to be programmable, so that it may control not only the volume and tone of the guitar, but other attributes and functions as well, including 2-way communication between arbitrary sensors, internal and external electronic devices and external control devices. The present invention further provides that the guitar's external control module consists of a smart phone, such as an iPhone.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

An electronic control and communication module is removably attached to the outer surface of a guitar by means of magnetic attraction between ferromagnetic metal or magnetic "feet" attached to the underside of the external control module and opposed magnets or ferromagnetic metal "anchors" mounted on the inside of the guitar. The external control module incorporates typical musician-controlled interface devices such as knobs and sliders for controlling volume and tone and similar musical attributes.

The external control module also incorporates an electronic processor, power supply and a wireless communication device enabling it to communicate with a separate processing module mounted elsewhere on, within or in the vicinity of the guitar. The external control module enables the musician to control various guitar functions as well as communicate with arbitrary communication-enabled internal and external devices including sensors, controllers and actuators.

In one aspect the invention is about a magnetic attachment mechanism for attaching at least one device to the external surface of a musical instrument such as a guitar, whereby said attachment mechanism comprises at least two magnetically attractive elements, said magnetically attractive elements each comprise either at least one magnet or at least one piece of ferromagnetic material, at least one said attractive element is mounted to the outer surface of the instrument and said at least one attractive element is mounted on the inner surface of the instrument, said inner and outer attractive elements are positioned approximately opposite one another, such that the inner and outer attractive elements are magnetically attracted to one another through the side of the instrument, said outer attractive element are configured to allow attachment to it of at least one external electronic device, said inner attractive element are configured to allow attachment to it of at least one internal electronic device, said outer attractive element presents a non-marring surface where it makes contact with the outer surface finish of the instrument and said inner and outer attractive elements are attracted to one another through the instrument wall with sufficient force to securely mount said at least one electronic device to the outer surface of the instrument, but not so strong as to prevent said at least one device from being easily removed.

In one aspect, the invention is about a magnetic attachment mechanism for attaching at least one device to the external surface of a musical instrument such as a guitar, whereby said attachment mechanism comprises at least two magnetically attractive elements, said magnetically attractive elements each comprise either at least one magnet or at least one piece of ferromagnetic material, at least one said attractive element is mounted to the outer surface of the instrument and said at least one attractive element is mounted on the inner surface of the instrument, said inner and outer attractive elements are positioned approximately opposite one another, such that the inner and outer attractive elements are magnetically attracted to one another through the side of the instrument, said outer attractive element are configured to allow attachment to it of at least one external electronic device, said inner attractive element are configured to allow attachment to it of at least one internal electronic device, said outer attractive element presents a non-marring surface where it makes contact with the outer surface finish of the instrument, and said inner and outer attractive elements are attracted to one another through the instrument wall with sufficient force to securely mount said at least one electronic device to the outer surface of the instrument, but not so strong as to prevent said at least one device from being easily removed.

Other features and advantages of the present invention will become apparent upon examining the following detailed description of an embodiment thereof, taken in conjunction with the attached drawings.

BRIEF DESCRIPTION OF THE DRAWINGS

FIGS. 6A, 6B and 6C show electronics displays and magnet mounting configurations for external electronic devices attached to a guitar body, according to exemplary embodiments of the invention.

FIG. 15 shows the one polarity (North or South) magnets on the inside plate, according to exemplary embodiments of the invention.

FIG. 16 shows the complementary polarity (South or North) magnets on the iPhone, according to exemplary embodiments of the invention.

FIG. 20 shows an external electronic device attached to a guitar body, according to exemplary embodiments of the invention.

FIG. 21 shows details of the external electronic device attached to a guitar body, according to exemplary embodiments of the invention.

Figure 1:
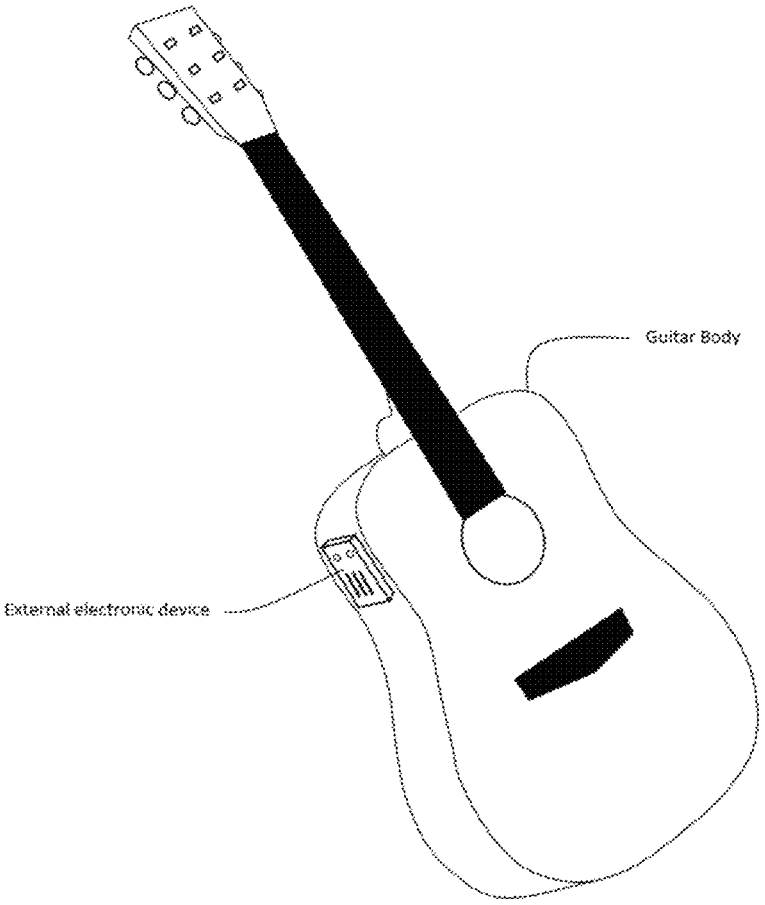
FIG. 1 shows an external electronic device attached to a guitar body, according to exemplary embodiments of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Referring to FIGS. 1-18, we see an exemplary embodiment of the invention which comprises a magnetic attachment mechanism for a stringed musical instrument such as a guitar, whereby an electronic device is magnetically attached to the outside surface of the instrument by magnetic attraction to one or more magnetic elements inside the instrument.

The external electronic device is attached to a mount that is equipped with one or more magnetically attractive elements or "feet" which are attracted to oppositely located magnetically attractive elements or "anchors" mounted on the inner surface of the instrument.

The attachment mechanism can comprise several different arrangements of magnetic attachment parts, and may be mounted through internal magnetic mount module, either permanently or removeably attached. For example, the external electronic device can be equipped with one or more magnet "feet" being attracted through the side wall to one or more magnet "anchors" mounted on the opposite inside surface of the guitar body, providing the strongest possible attachment.

Alternatively, the magnet "feet" on the external device mount can be substituted with one or more pieces of ferromagnetic metal, which are attracted to the internally mounted magnets. Alternatively, the one or more magnets mounted on the inner surface can be substituted by one or more ferromagnetic metal feet, which are attracted to the mounting magnets of the external electronic device.

The attachment surface of the external magnets or metal pieces are coated with a soft material, for example rubber or cork, to prevent marring of the guitar's finish. The external device mount can be configured to hold arbitrary electronic devices on the instrument, for example a smart phone. FIG. 1 shows a typical acoustic guitar equipped with an external electronic control module.

Figure 2:
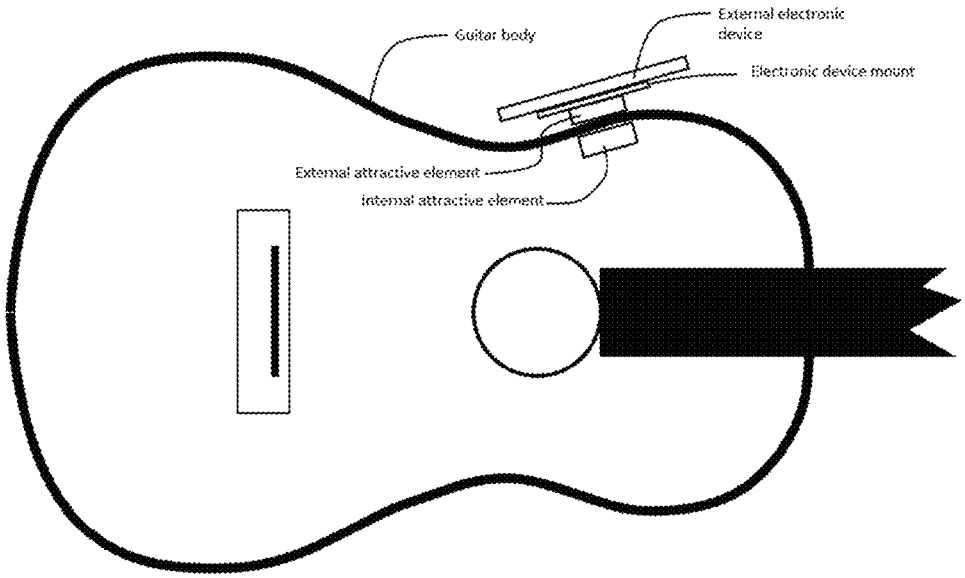
FIG. 2 shows an external electronic device attached to a guitar body, according to exemplary embodiments of the invention.

FIG. 2 shows a schematic transparent plan view of the guitar body including the invention magnetic device attachment mechanism. Inside the guitar is a magnetically attractive element, which may or may not be bonded to the inner wall. The outer attractive element is attracted to the internal element strongly enough to hold it firmly in place against the outer surface of the guitar. The outer attractive element has attached to it a mounting device for attaching an external electronic control device.

Figure 3:
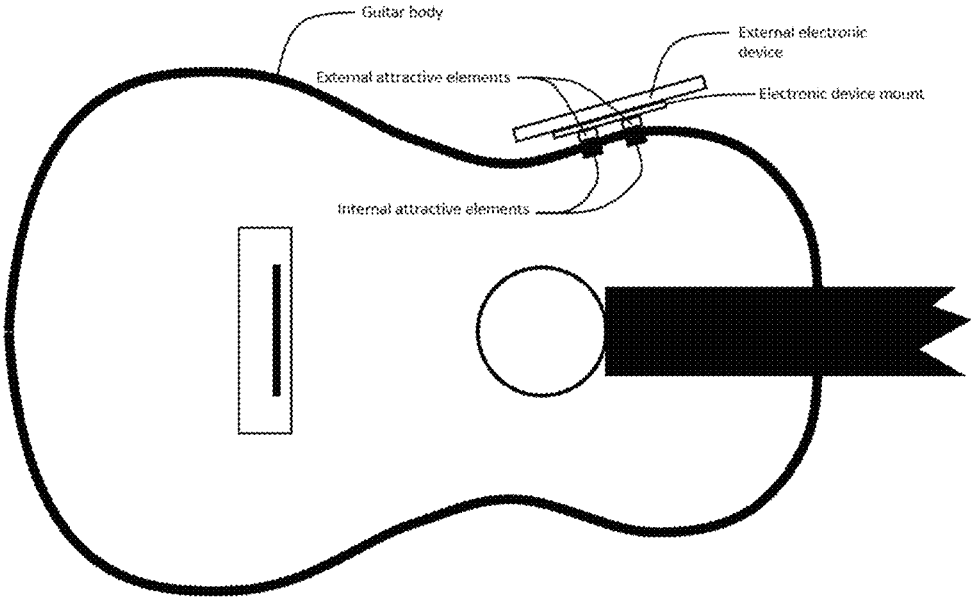
Figure 4:
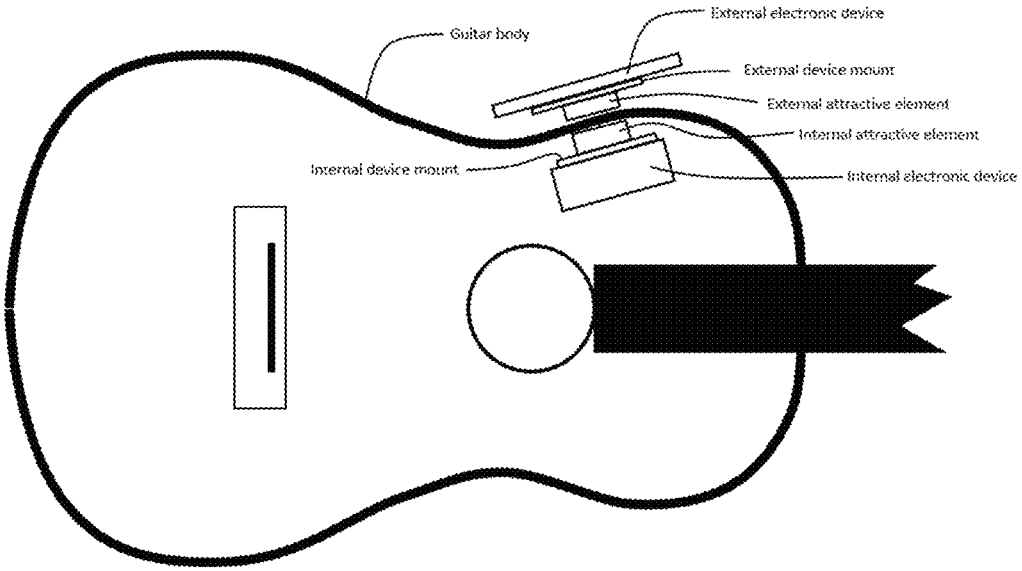
FIG. 4 shows an external electronic device attached to a guitar body, according to exemplary embodiments of the invention.

FIG. 3 shows a schematic transparent plan view of the invention attachment mechanism, where the single magnetically attractive inner and outer elements are replaced by an array of at least two such internal elements, and preferably three or four such elements in order to more precisely align the external electronic device. FIG. 4 shows a schematic transparent plan view of the invention attachment mechanism, where the internal magnetically attractive element has mounted to it a separate electronics module in wireless communication with the external electronic device, and providing additional functionality.

Figure 5:
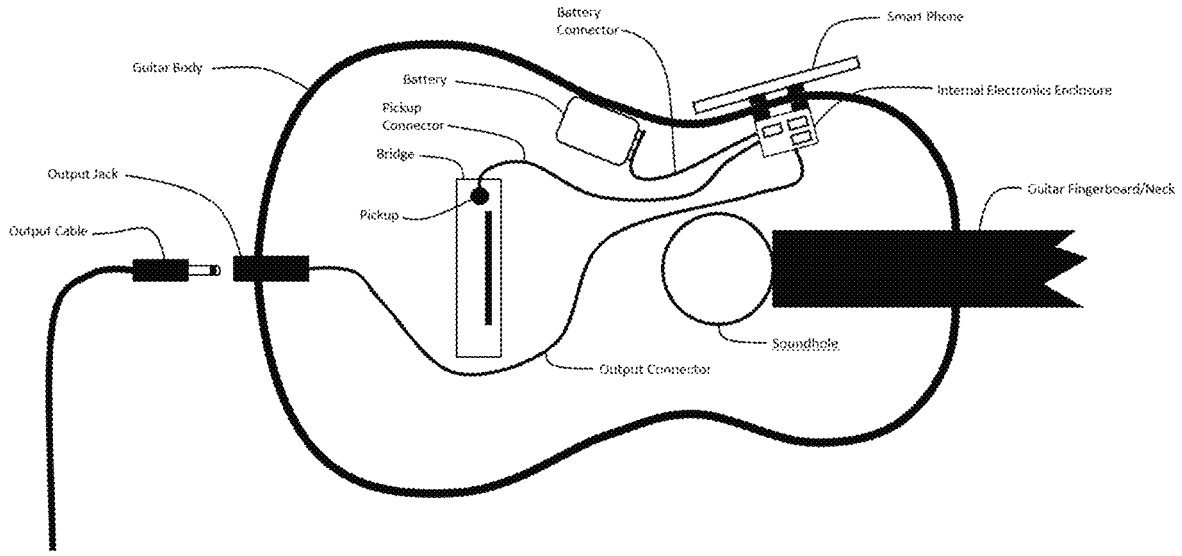
FIG. 5 shows an external electronic device attached to a guitar body with an additional output cable, according to exemplary embodiments of the invention.
Figure 7:
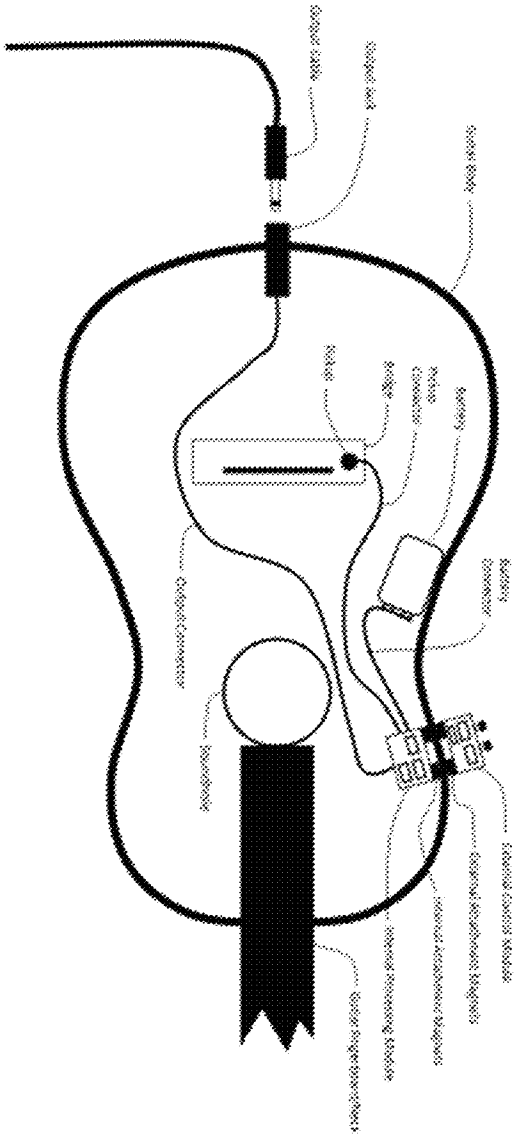
FIG. 7 shows an external electronic device attached to a guitar body with an additional output cable, according to exemplary embodiments of the invention.
Figure 8:
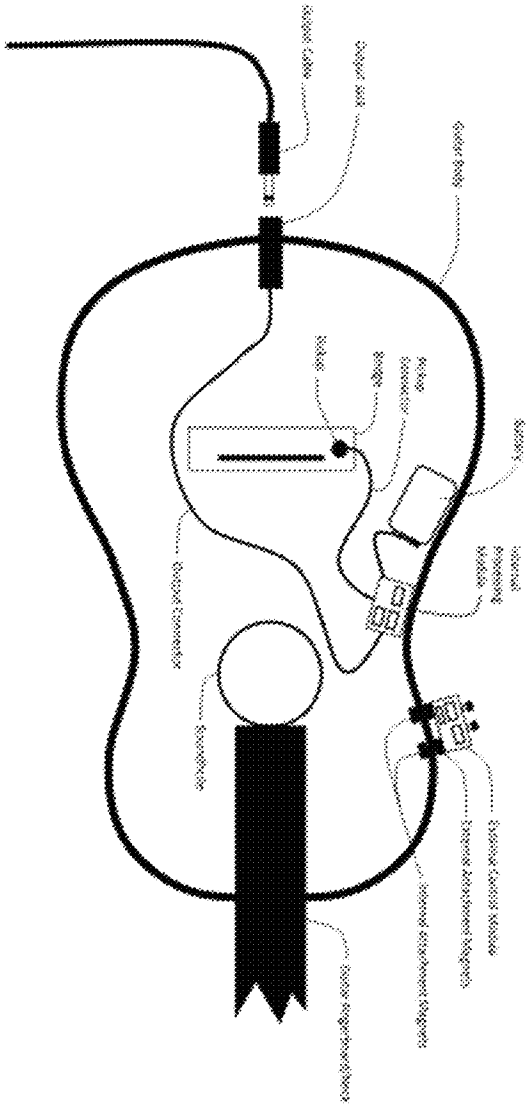
FIG. 8 shows an external electronic device attached to a guitar body with an additional output cable, according to exemplary embodiments of the invention.
Figure 9:
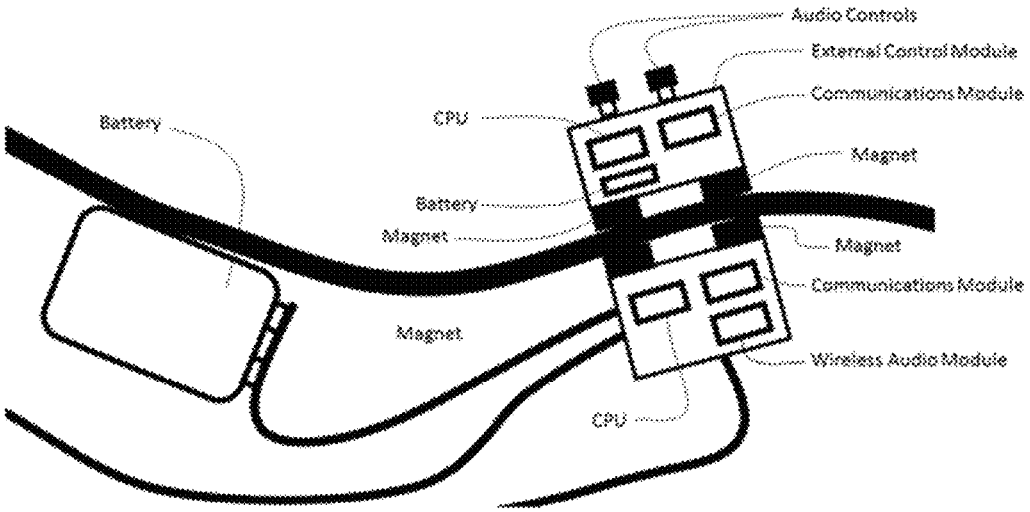
FIG. 9 shows the details of the electronic device attached to a guitar body, according to exemplary embodiments of the invention.
Figure 10:
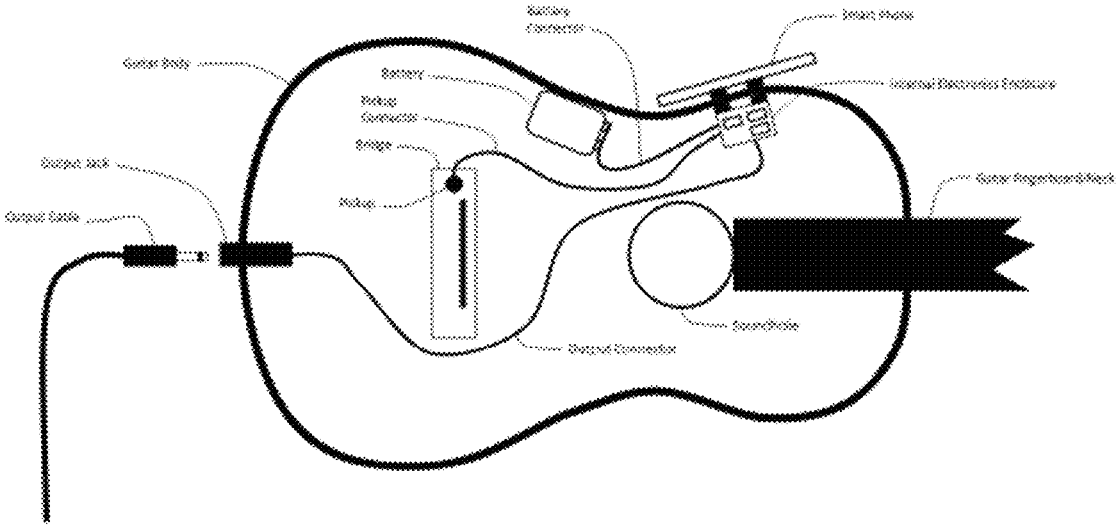
FIG. 10 shows an external electronic device attached to a guitar body with an additional output cable, according to exemplary embodiments of the invention.
Figure 11:
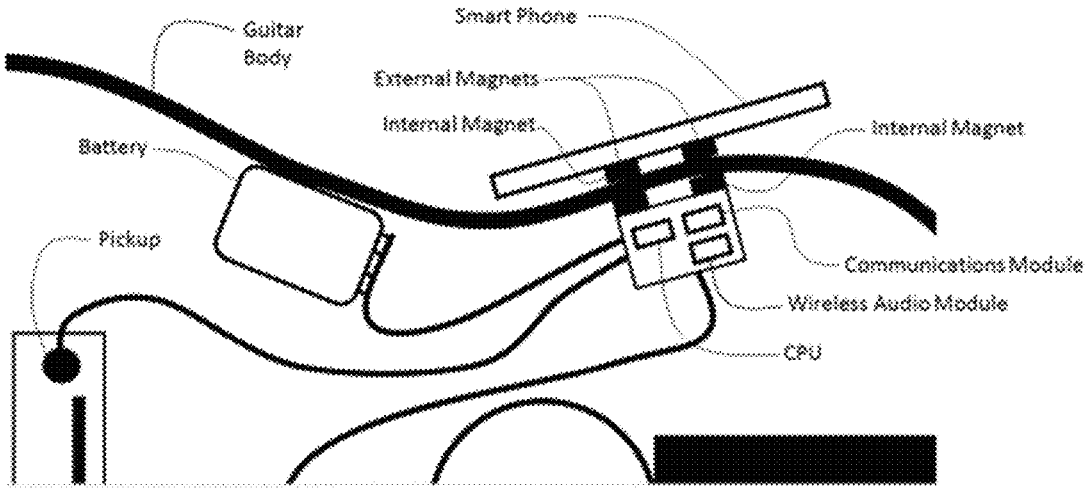
FIG. 11 shows the details of the electronic device attached to a guitar body, according to exemplary embodiments of the invention.
Figure 12:
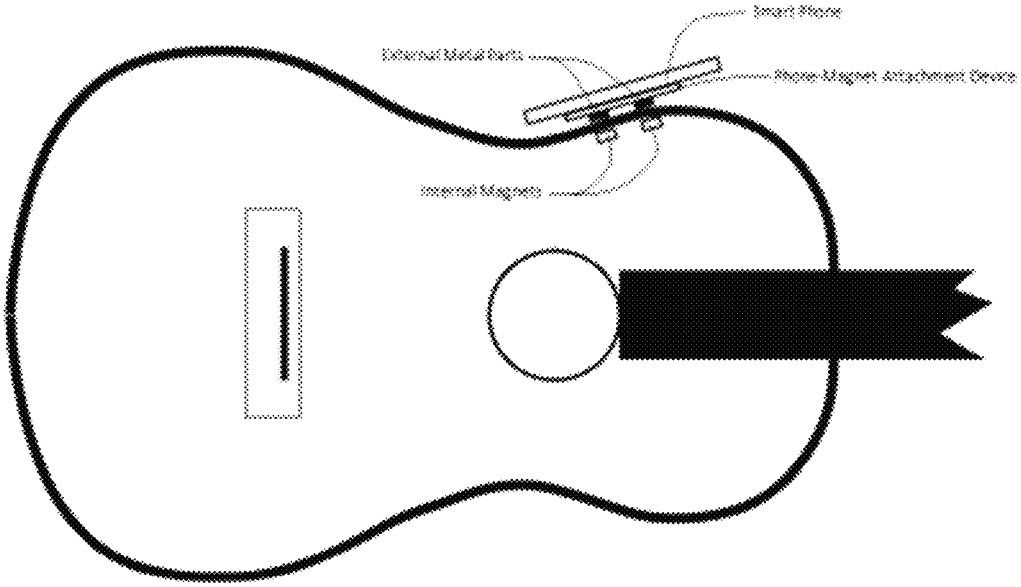
FIG. 12 shows an external electronic device attached to a guitar body, according to exemplary embodiments of the invention.
Figure 13:
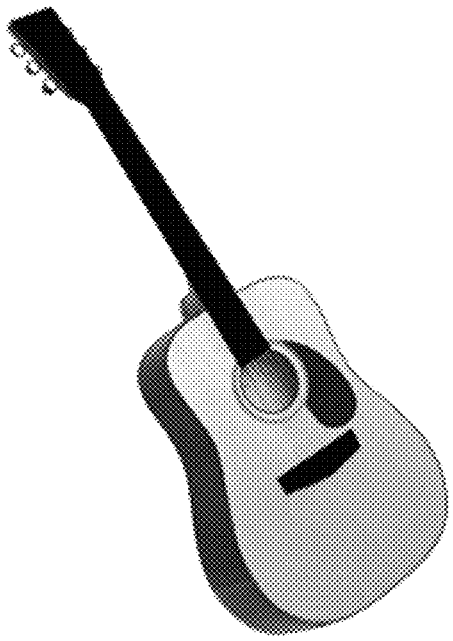
FIG. 13 shows a guitar body, according to exemplary embodiments of the invention.
Figure 14:
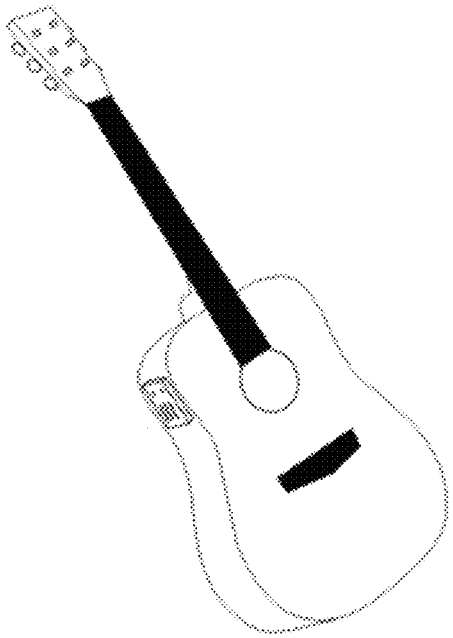
FIG. 14 shows a guitar body with the device attached, according to exemplary embodiments of the invention.
Figure 17:
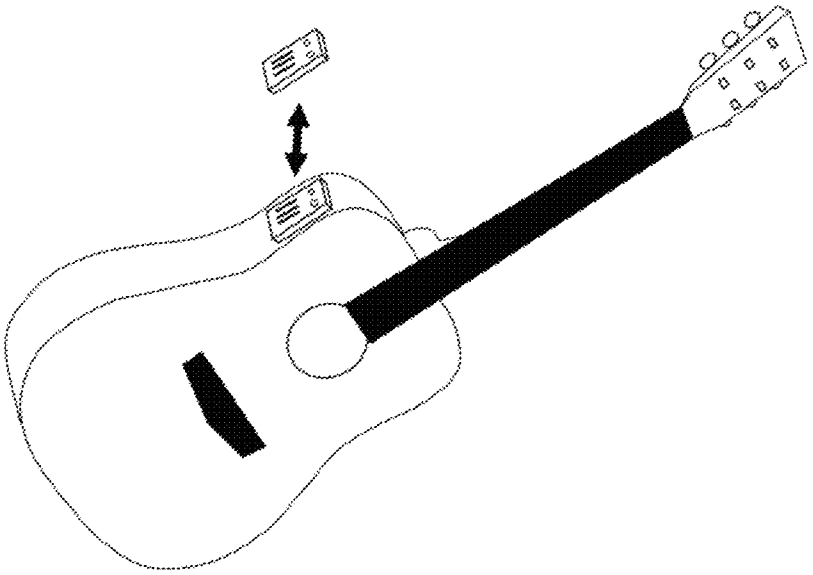
FIG. 17 shows an external electronic device attached to a guitar body with an additional output cable, according to exemplary embodiments of the invention.
Figure 18:
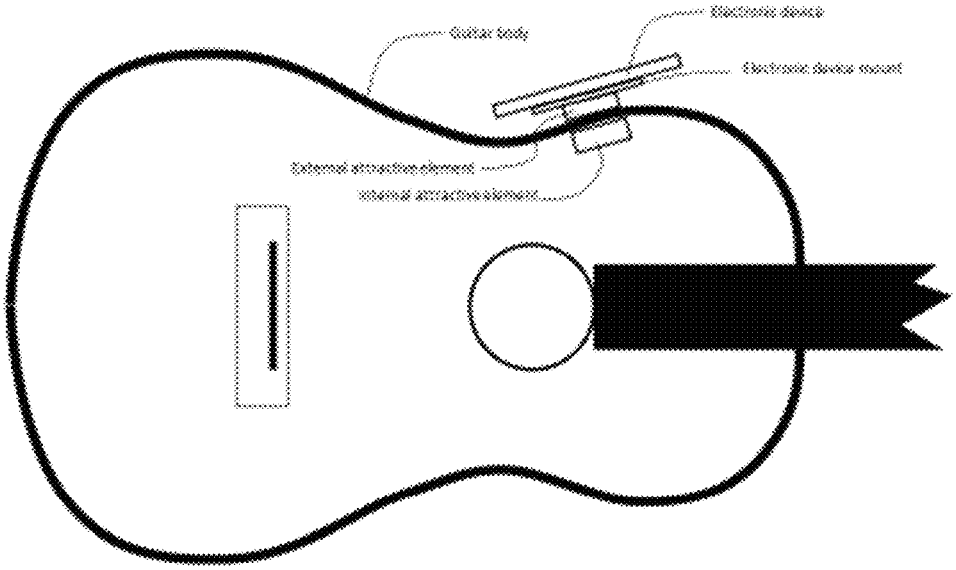
FIG. 18 shows an external electronic device attached to a guitar body, according to exemplary embodiments of the invention.
Figure 19:
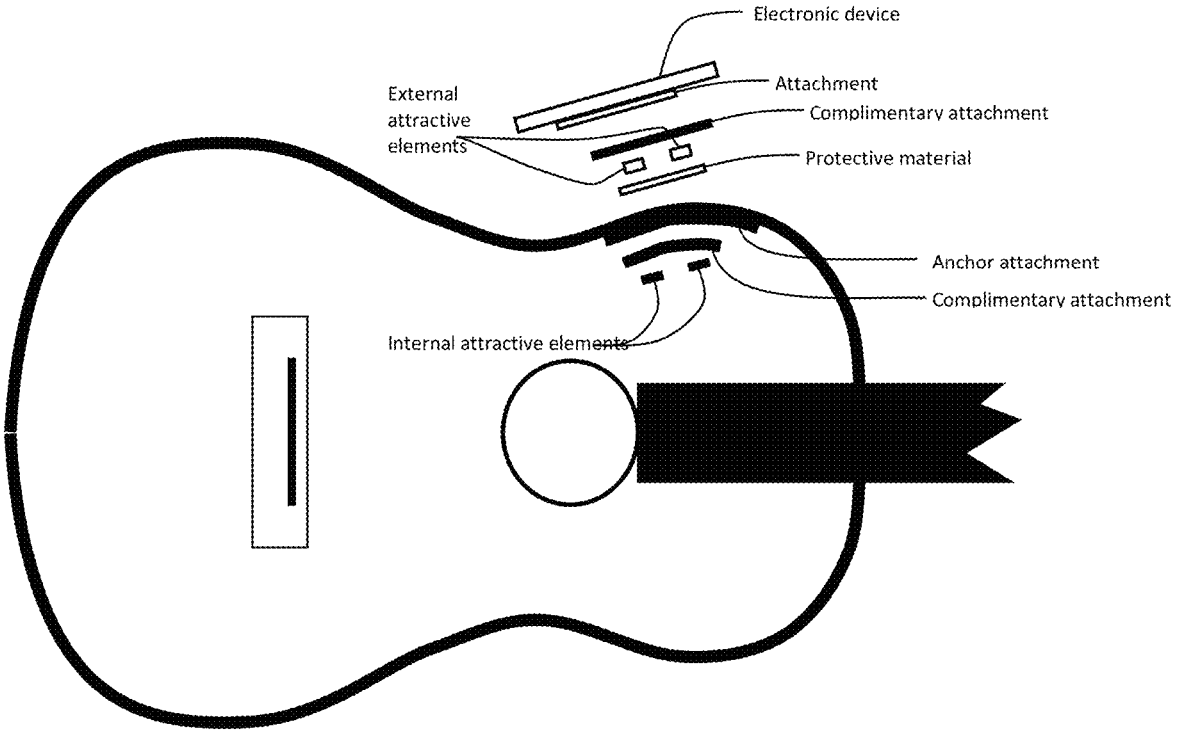
FIG. 19 shows details of the components of an external electronic device attached to a guitar body, according to exemplary embodiments of the invention.
Figure 22:
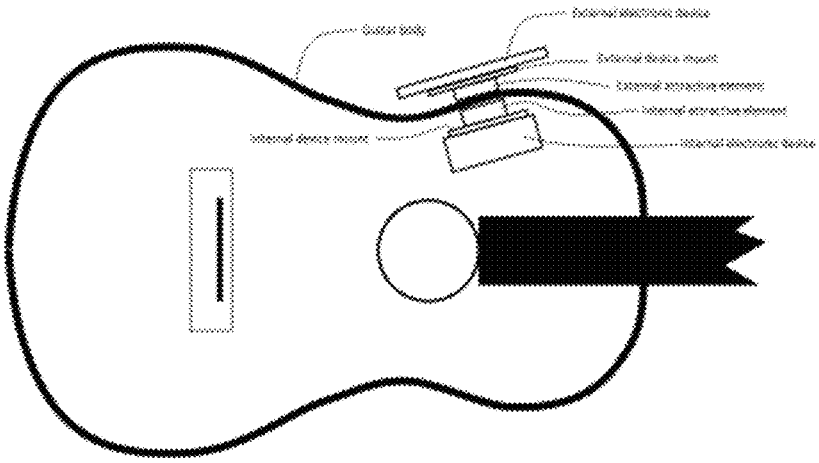
FIG. 22 shows an external electronic device attached to a guitar body, according to exemplary embodiments of the invention.
Figure 23:
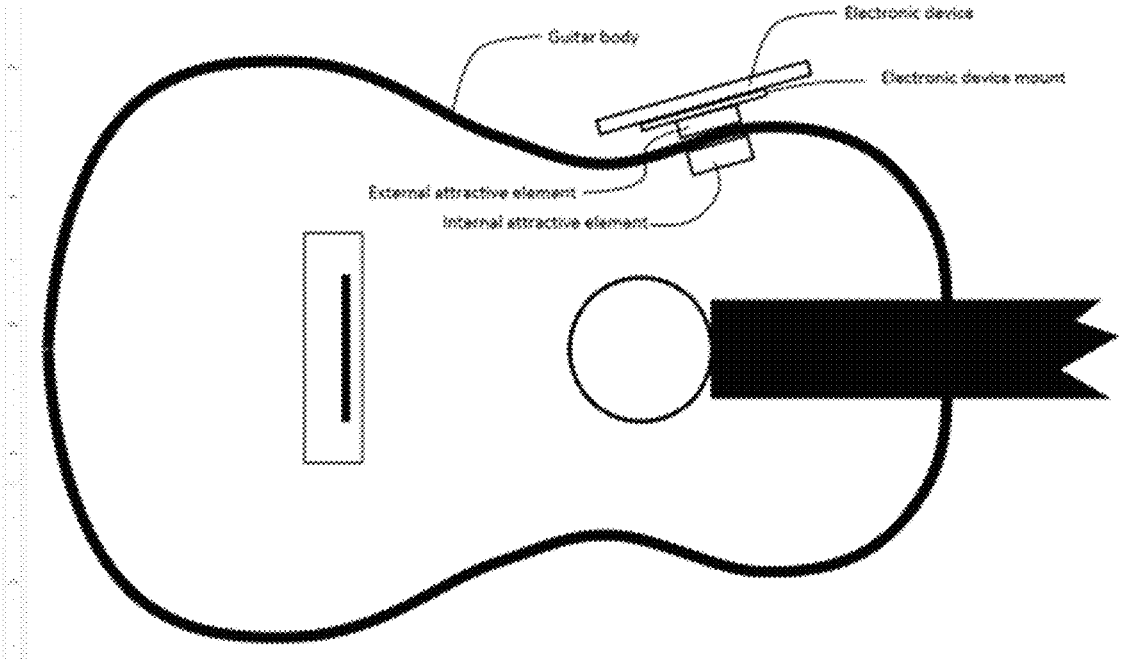
FIG. 23 shows the details of the electronic device attached to a guitar body, according to exemplary embodiments of the invention.
Figure 24:
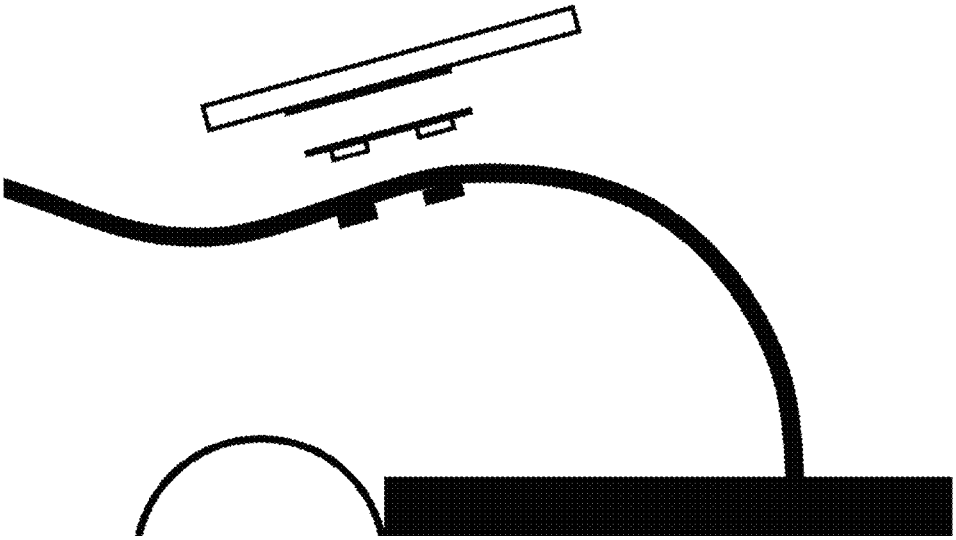
FIG. 24 shows the details of the electronic device attached to a guitar body, according to exemplary embodiments of the invention.
Figure 25A:
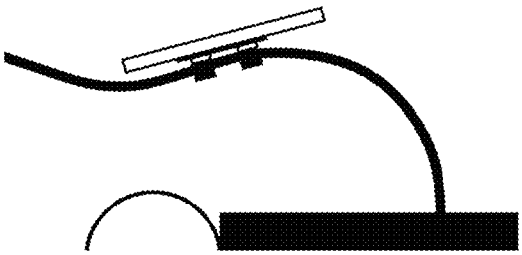
FIG. 25A and FIG. 25B show the details of the electronic device attached to a guitar body, according to exemplary embodiments of the invention.
Figure 25B:
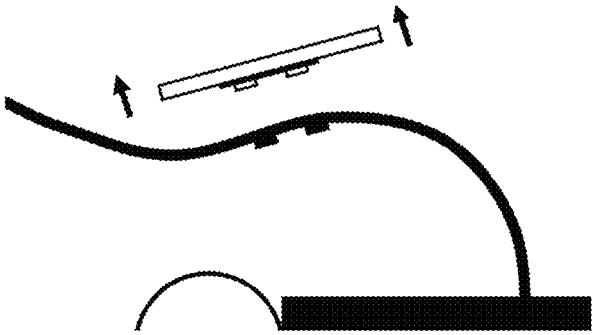
Figure 26:
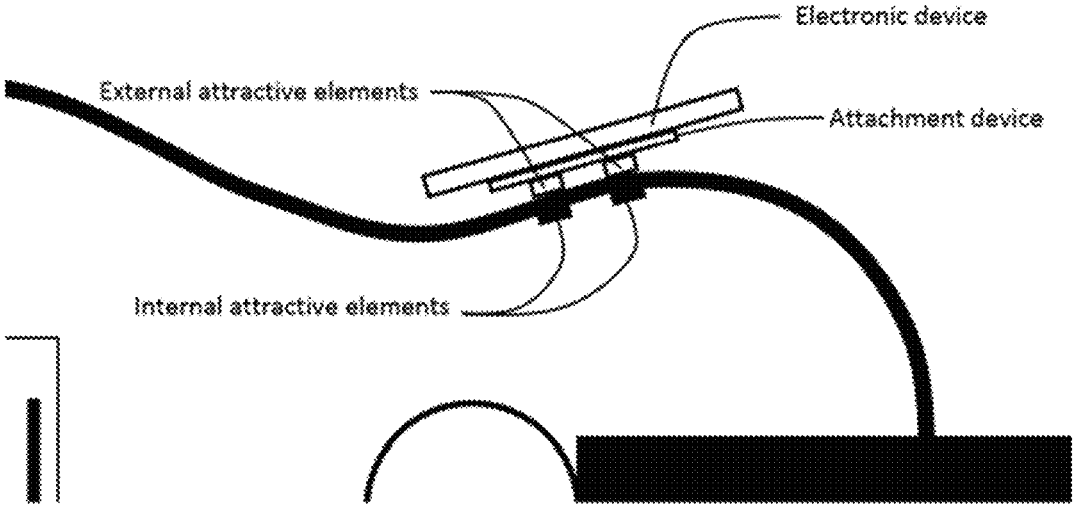
FIG. 26 shows the details of the electronic device attached to a guitar body, according to exemplary embodiments of the invention.

FIG. 5 shows one embodiment of the invention, where the external control module is a smart phone held in place with an array of external magnets, such external magnets being strongly attracted to a corresponding array of internally mounted magnets. The internal magnet array in turn provides a mount for a separate internal electronics module, which receives a weak audio signal from the pickup on the bridge, and amplifies and modifies the output signal according to wireless control signals created by software applications running on the external smart phone.

FIGS. 6A-6C show the front and back of a smart phone equipped with one embodiment of the disclosed invention. FIG. 6A shows the front of the phone, and FIG. 6B shows the back of the phone, where an array of magnets is shown attached to the phone. The array of magnets can be fixed or removably attached to the back of the phone, for example with hook-and-loop fasteners. Alternatively, the array of magnets can be made removable by being built into or attached to the phone's removable case. The letter "N" shown on each magnet indicates the "north" magnetic polarity of each magnet visible in that particular view. FIG. 6C shows the same front view of the phone as FIG. 6A, however shown in outline is the location and polarity of the attached magnet array on the back side of the phone.

Some of the magnetically mounted electronic devices include Smart phone/pad and other arbitrary electronic device/controllers. The products supported include but are not limited to; Magnet patch mounting kits (2 patches & anchor loop strip); Hardware (including Smart internal pre-amp; External tone control module; Stage/recording quality external sound system; as well as Phone case with embedded magnets).

Similarly the possible Software apps include (Display tablature/lyrics); Control music devices (Live recording/playback on smart phone; Control smart internal pre-amp; Control smart external pre-amp/dsp/recording devices).

The market(s) services include: Receiving—Lyrics/Tablature/Play-along apps; Live recording to smart phone; Music Skype (latency issue); Transmitting—Wireless interface to arbitrary external or internal controller, i.e. sound system/stage lighting system/drone, etc.

Figure 27:
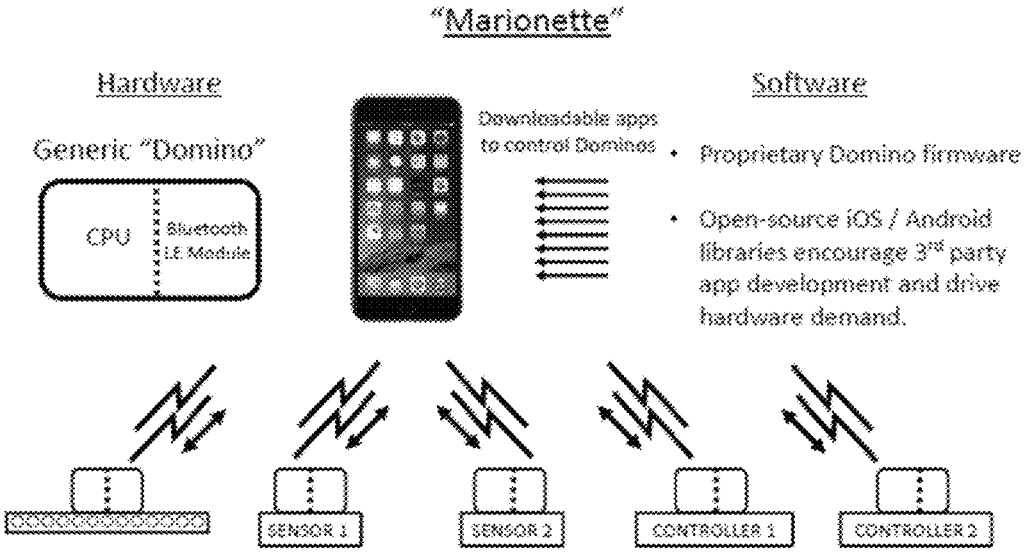
FIG. 27 shows an illustration of the marionette system, according to an exemplary embodiment of the invention.
Figure 28:
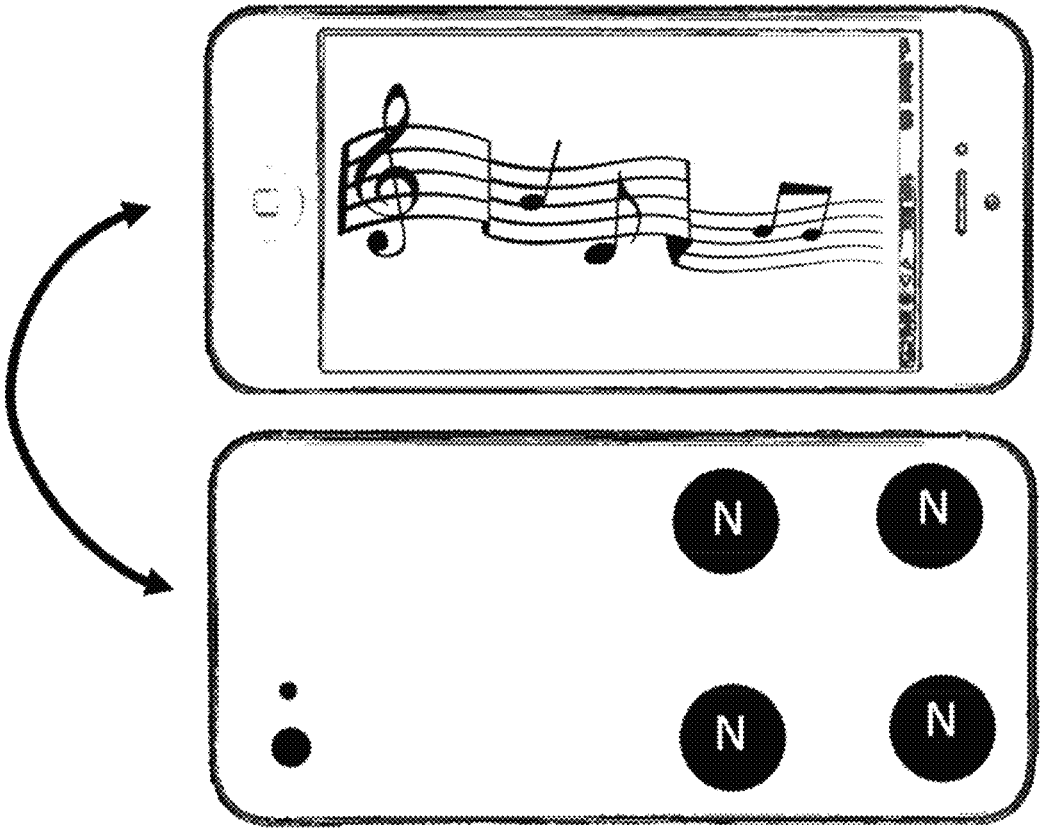
FIG. 28 shows the details of the electronic device attached to a guitar body, according to exemplary embodiments of the invention.
Figure 29:
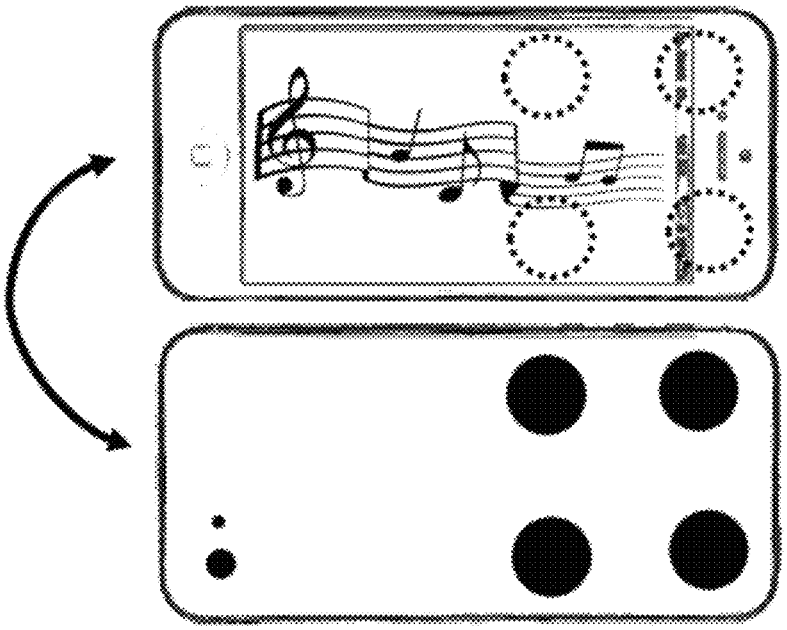
FIG. 29 shows the details of the electronic device attached to a guitar body, according to exemplary embodiments of the invention.
Figure 30:
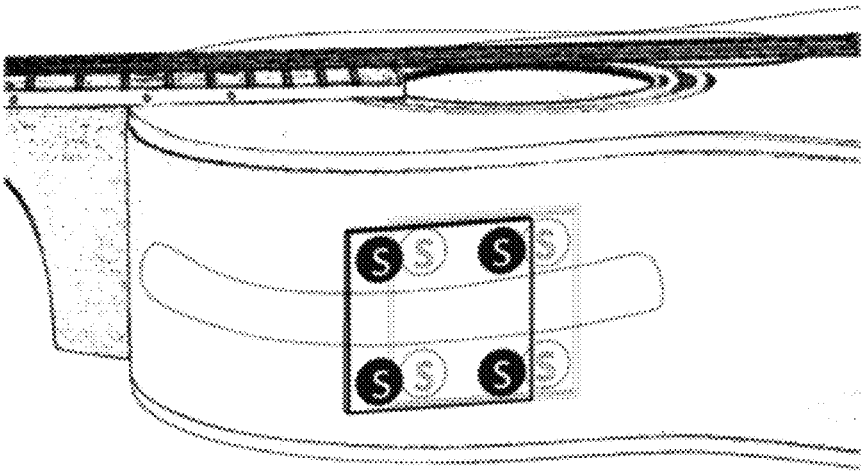
FIG. 30 shows the details of the electronic device attached to a guitar body, according to exemplary embodiments of the invention.
Figure 31:
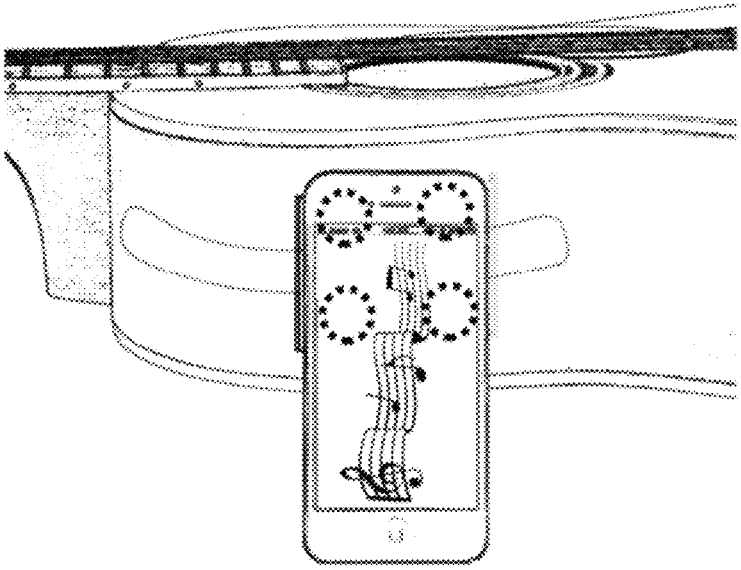
FIG. 31 shows the details of the electronic device attached to a guitar body, according to exemplary embodiments of the invention.
Figure 32:
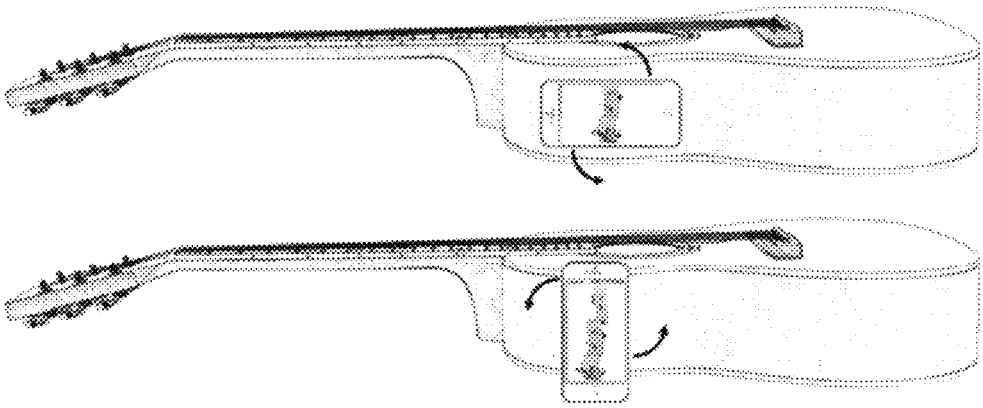
FIG. 32 shows the details of the electronic device attached to a guitar body, according to exemplary embodiments of the invention.
Figure 33:
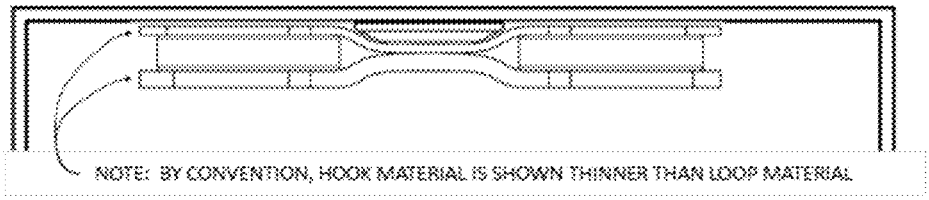
FIG. 33 shows the details of the electronic device attached to a guitar body, according to exemplary embodiments of the invention.
Figure 34:
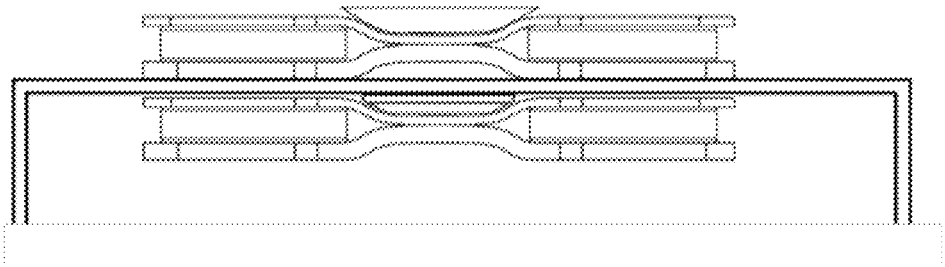
FIG. 34 shows the details of the electronic device attached to a guitar body, according to exemplary embodiments of the invention.
Figure 35:
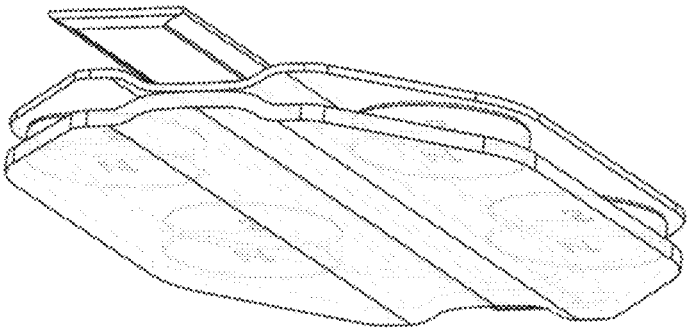
FIG. 35 shows the details of the electronic device attached to a guitar body, according to exemplary embodiments of the invention.
Figure 36:
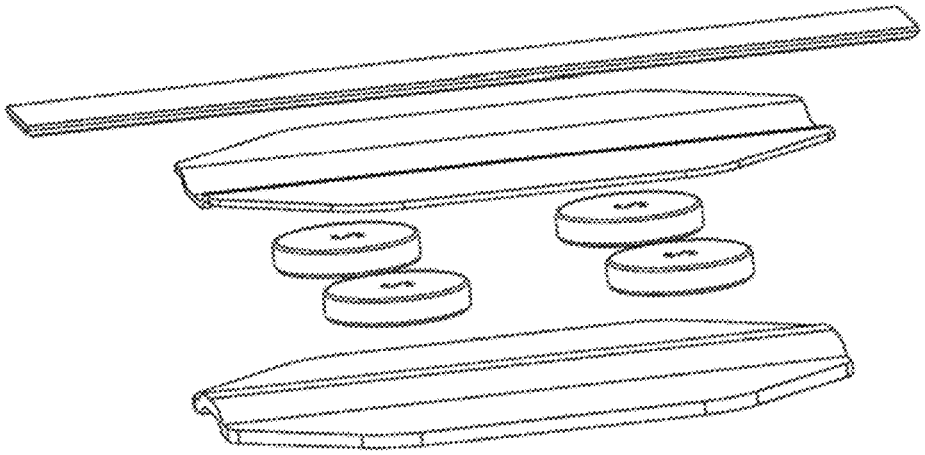
FIG. 36 shows the details of the electronic device attached to a guitar body, according to exemplary embodiments of the invention.
Figure 37:
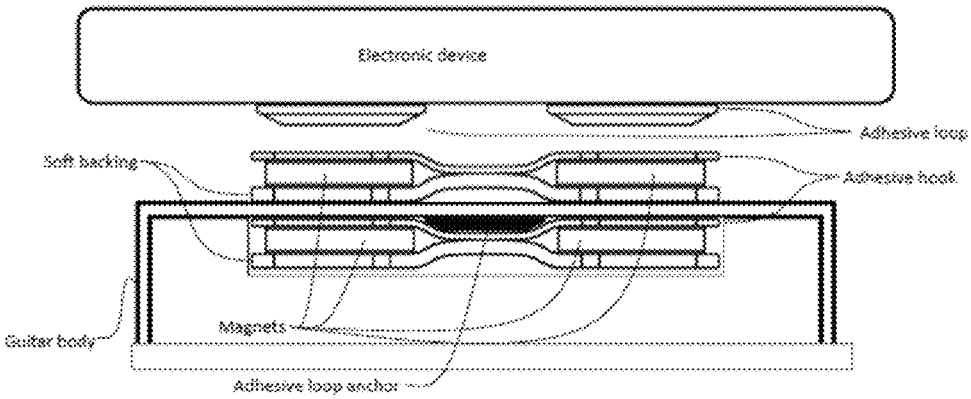
FIG. 37 shows the details of the electronic device attached to a guitar body, according to exemplary embodiments of the invention.
Figure 38:
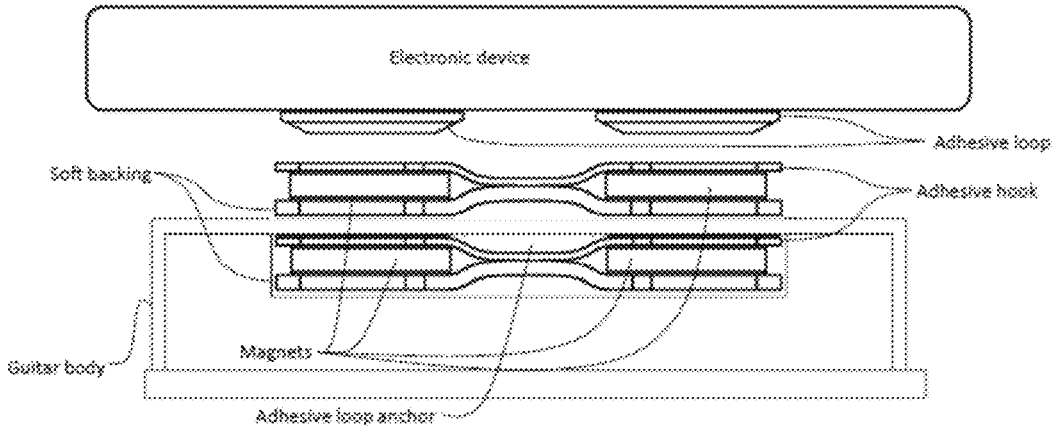
FIG. 38 shows the details of the electronic device attached to a guitar body, according to exemplary embodiments of the invention.
Figure 39:
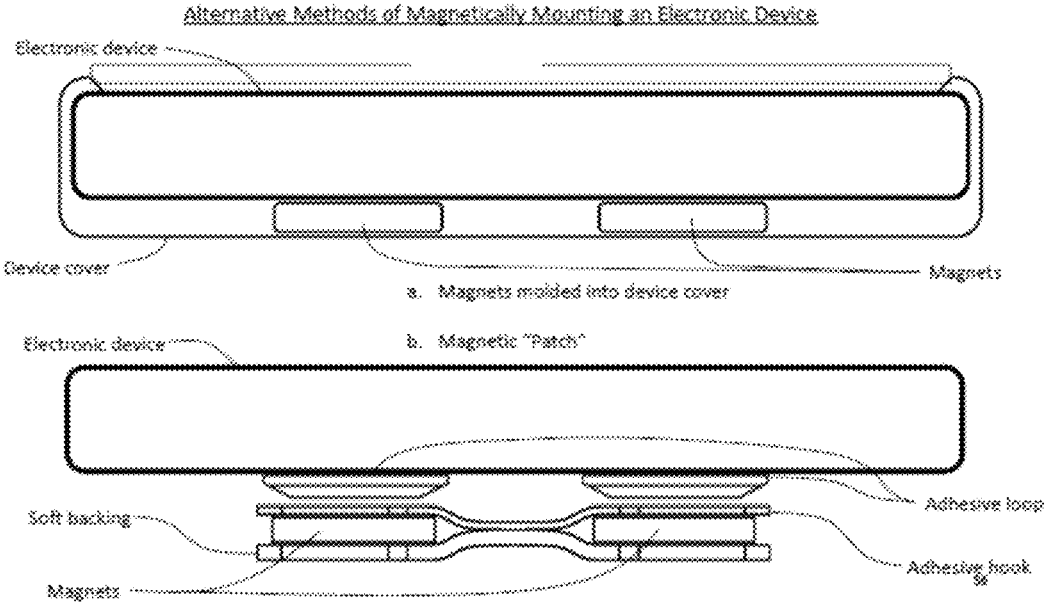
FIG. 39 shows the details of the electronic device attached to a guitar body, according to exemplary embodiments of the invention.
Figure 40:
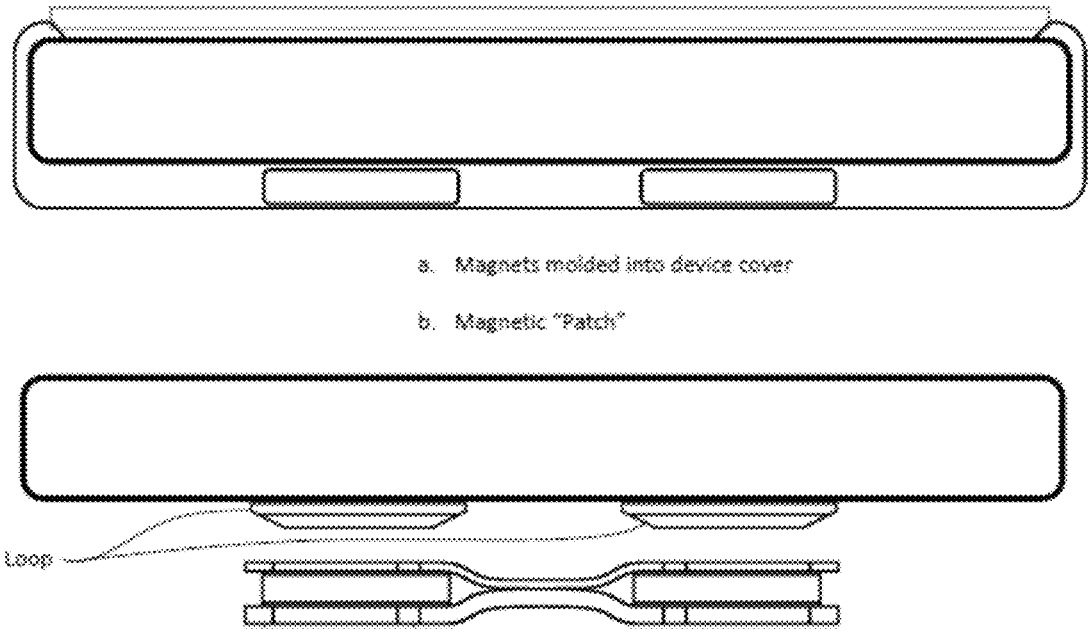
FIG. 40 shows the details of the electronic device attached to a guitar body, according to exemplary embodiments of the invention.

Referring to FIG. 27, we see a scheme where a smart device (smartphone/tablet/smartwatch and/or PC), let's say an iPhone can communicate with and control any of the domino-equipped sensors or controllers in range. In one embodiment, the Marionette connects to the magnetically attached external guitar controller so that a volume- and tone-modulating device located in or in the vicinity of the guitar may be controlled by the iPhone mounted on the guitar.

For example, a separate LED light-show on the instrument or musician or guitar or stage could be controlled simultaneously from the same iPhone, or as many slave devices as the musician could handle. By having all slave device processing being done separate from the controller/iphone, there would not be any iphone bandwidth issues.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. A removable magnetic attachment mechanism for attaching at least one device to the external surface of a musical instrument such as a guitar, whereby:

said attachment mechanism comprises at least two magnetically attractive elements, each comprised of at least one magnet;

a first said magnetically attractive element is designed to be mounted to the outer surface of the instrument a second said magnetically attractive element is designed to be removably attached at two or more points along an axial direction of a strip of material mounted to the inner surface of said musical instrument;

said inner and outer attractive elements are positioned approximately opposite one another, such that the inner and outer attractive elements are magnetically attracted to one another through the side of the instrument;

said outer attractive element are configured to allow attachment to it of at least one external electronic device;

said inner attractive element are configured to allow attachment to it of at least one internal electronic device;

said outer attractive element presents a non-marring surface where it makes contact with the outer surface finish of the instrument; and said inner and outer attractive elements are attracted to one another through the instrument wall with sufficient force to securely mount said at least one electronic device to the outer surface of the instrument, but not so strong as to prevent said at least one device from being easily removed.

2. The magnetic attachment mechanism of claim 1 wherein;

said strip of material mounted inside said musical instrument is comprised of hooks-and-loops; and said second magnetically attractive element has a complementary portion of hooks-and-loops material permanently attached to said second element's surface.

* * * * *